US010309177B2

(12) United States Patent
Sale et al.

(10) Patent No.: US 10,309,177 B2
(45) Date of Patent: Jun. 4, 2019

(54) CRYOGENIC CORE COLLECTION

(71) Applicants: Colorado State University Research Foundation, Fort Collins, CO (US); Richard L. Johnson, Portland, OR (US); Richard C. Rogers, Fort Collins, CO (US)

(72) Inventors: Thomas C. Sale, Bellvue, CO (US); Richard L. Johnson, Portland, OR (US); Richard C. Rogers, Fort Collins, CO (US); Saeed Kiaalhosseini, Kitchener (CA)

(73) Assignees: Colorado State University Research Foundation, Fort Collins, CO (US); Richard L. Johnson, Portland, OR (US); Richard C. Rogers, Fort Collins, CO (US)

( * ) Notice: Subject to any disclaimer, the term of this patent is extended or adjusted under 35 U.S.C. 154(b) by 101 days.

(21) Appl. No.: 15/624,183

(22) Filed: Jun. 15, 2017

(65) Prior Publication Data

US 2017/0362908 A1 Dec. 21, 2017

Related U.S. Application Data

(60) Provisional application No. 62/350,705, filed on Jun. 15, 2016.

(51) Int. Cl.

| | |
|---|---|
| ***E21B 25/06*** | (2006.01) |
| ***E21B 25/08*** | (2006.01) |
| ***E21B 7/00*** | (2006.01) |

(52) U.S. Cl.
CPC ..... *E21B 25/08* (2013.01); *E21B 7/006* (2013.01); *E21B 25/06* (2013.01)

(58) Field of Classification Search
CPC ..... E21B 25/06; E21B 25/08; E21B 25/10; E21B 7/006; E21B 10/02
See application file for complete search history.

(56) References Cited

U.S. PATENT DOCUMENTS

2009/0229382 A1* 9/2009 Sun ..... G01N 1/08 73/863.11
2012/0012393 A1* 1/2012 Kumar ..... E21B 25/00 175/58

* cited by examiner

*Primary Examiner* — D. Andrews
*Assistant Examiner* — Yanick A Akaragwe
(74) *Attorney, Agent, or Firm* — Polsinelli PC

(57) ABSTRACT

A system and method for collecting a core sample. The system includes an outer cylindrical tube, a drive head, a drive shoe, a cooling chamber housed inside the outer cylindrical tube, insulation, a core sample liner, an inlet tube, and outlet tube. The drive shoe further comprises a first, second, and third step, the first step configured to receive the insulation, the second step configured to receive the cooling chamber, the third step configured to receive the core sample liner, wherein the first step has a diameter larger than the second step and the second step has a diameter larger than the third step. The method includes drilling a hole in the ground with a drilling tool, enclosing a core sample by a core sample liner, freezing the core sample via a cooling liquid, retrieving the drilling tool at a surface of the ground, and removing the core sample encased in the core sample liner from the cooling chamber.

20 Claims, 18 Drawing Sheets

FEW-M700
Recovery (%)
0
20
40
60
80
100
9.0-11.5
11.5-14.0
14.0-16.5
16.5-17.5
Interval Depth (ft)
0
2
4
6
8
10
Time of LN Injection (min)

Former Refinery-E1D
Recovery (%)
0
20
40
60
80
100
0.0-2.5
2.5-4.5
4.5-7.0
7.0-9.5
9.5-12.0
Interval Depth (ft)
0
2
4
6
8
10
Time of LN Injection (min)
Recovery (%)
Time of LN Injection (min)

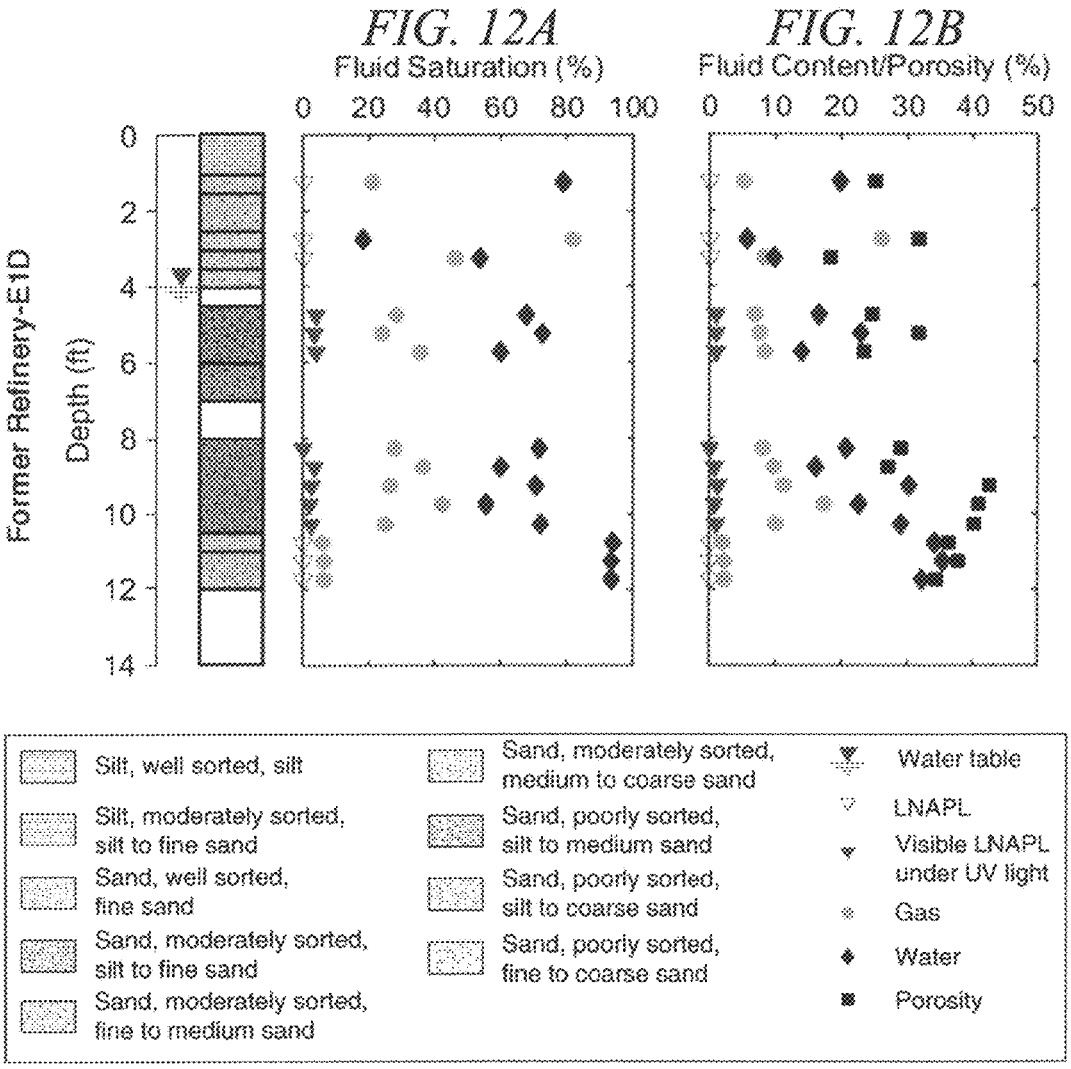
FIG. 12A
Fluid Saturation (%)
0 20 40 60 80 100
FIG. 12B
Fluid Content/Porosity (%)
0 10 20 30 40 50
Former Refinery-E1D
Depth (ft)
0 2 4 6 8 10 12 14
Silt, well sorted, silt
Silt, moderately sorted, silt to fine sand
Sand, well sorted, fine sand
Sand, moderately sorted, silt to fine sand
Sand, moderately sorted, fine to medium sand
Sand, moderately sorted, medium to coarse sand
Sand, poorly sorted, silt to medium sand
Sand, poorly sorted, silt to coarse sand
Sand, poorly sorted, fine to coarse sand
Water table
LNAPL
Visible LNAPL under UV light
Gas
Water
Porosity

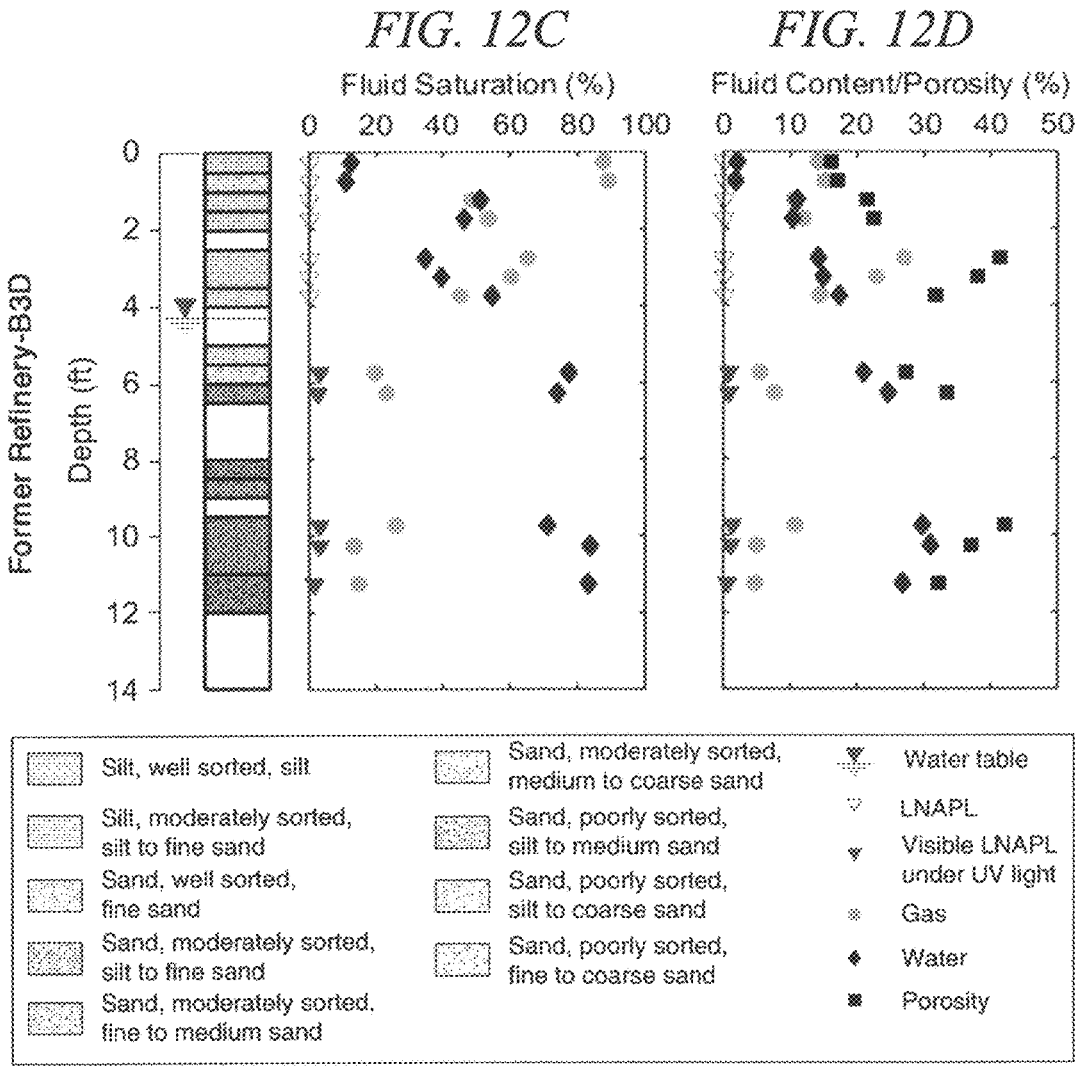
FIG. 12C
FIG. 12D
Fluid Saturation (%)
0 20 40 60 80 100
Fluid Content/Porosity (%)
0 10 20 30 40 50
Former Refinery-B3D
Depth (ft)
0 2 4 6 8 10 12 14
Silt, well sorted, silt
Silt, moderately sorted, silt to fine sand
Sand, well sorted, fine sand
Sand, moderately sorted, silt to fine sand
Sand, moderately sorted, fine to medium sand
Sand, moderately sorted, medium to coarse sand
Sand, poorly sorted, silt to medium sand
Sand, poorly sorted, silt to coarse sand
Sand, poorly sorted, fine to coarse sand
Water table
LNAPL
Visible LNAPL under UV light
Gas
Water
Porosity

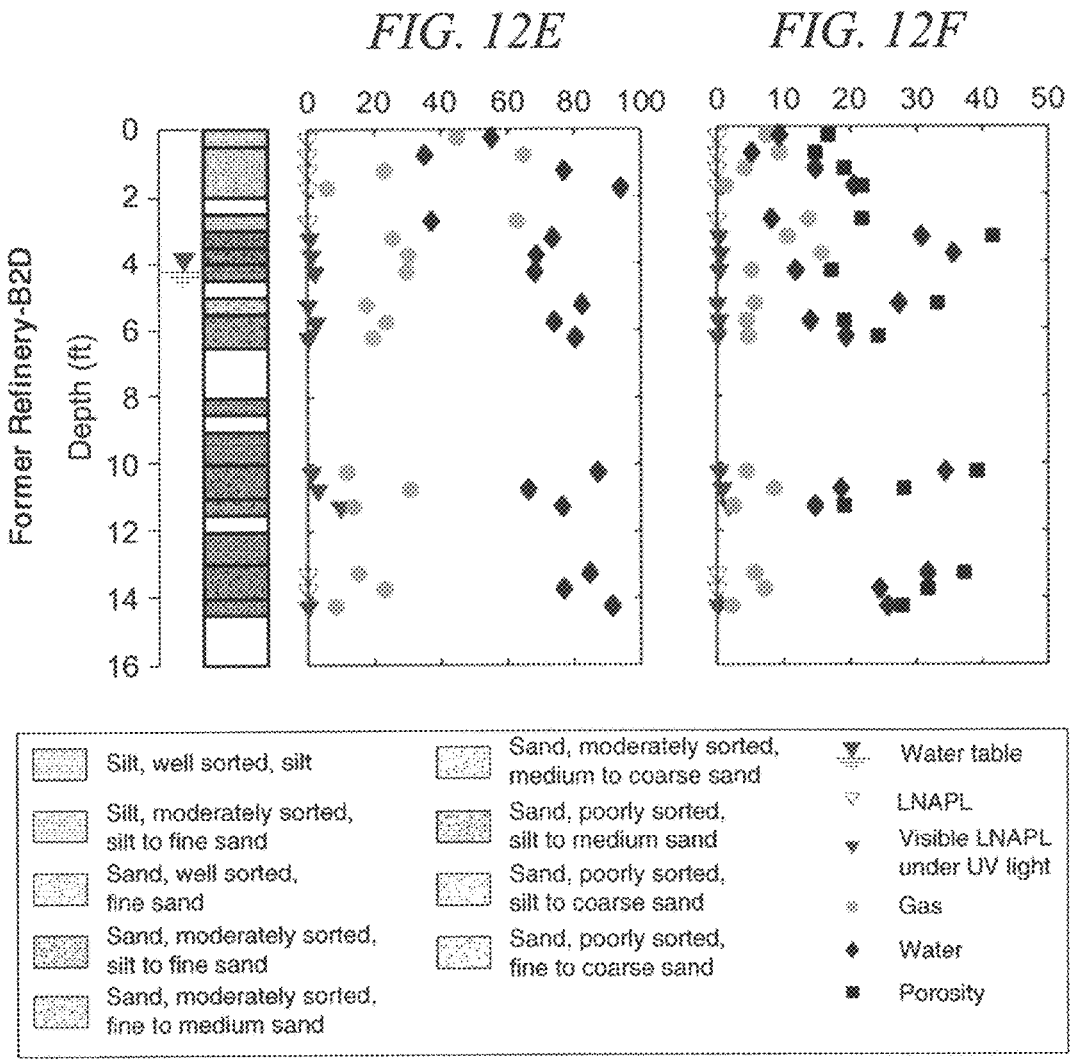
FIG. 12E
FIG. 12F
Former Refinery-B2D
Depth (ft)
0
2
4
6
8
10
12
14
16
0 20 40 60 80 100
0 10 20 30 40 50
Silt, well sorted, silt
Silt, moderately sorted, silt to fine sand
Sand, well sorted, fine sand
Sand, moderately sorted, silt to fine sand
Sand, moderately sorted, fine to medium sand
Sand, moderately sorted, medium to coarse sand
Sand, poorly sorted, silt to medium sand
Sand, poorly sorted, silt to coarse sand
Sand, poorly sorted, fine to coarse sand
Water table
LNAPL
Visible LNAPL under UV light
Gas
Water
Porosity

CRYOGENIC CORE COLLECTION

CROSS-REFERENCE TO RELATED APPLICATIONS

The present application claims benefit under 35 U.S.C. § 119(e) of the filing date of U.S. Provisional Patent Application No. 62/350,705, entitled "Cryogenic Core Collection", filed on Jun. 15, 2016, which is specifically incorporated by reference herein in its entirety.

STATEMENT REGARDING FEDERAL RIGHTS

This invention was made with government support under Grant No. W912HQ-10-C-0061 awarded by the U.S. Department of Defense. The government has certain rights in the invention.

TECHNICAL FIELD

Aspects of the present disclosure relate systems and methods for collecting a core sample and more particularly to cryogenic core collection.

BACKGROUND

Many disciplines collect core samples from subsurface media to capture attributes of underlying materials, such as physical, chemical, and biological characteristics. Observing these attributes may assist in effective decision making concerning projects that rely on the soils characteristics. One method to collect a core sample involves cryogenic core collection, or in situ freezing, which freezes the core sample to preserve the various characteristics of the sample. Conventional methods of cryogenic core collections may suffer from corrupted, low quality samples, especially in unconsolidated subsurface media. Furthermore, pore fluids may drain from the core and be replaced by atmospheric gases during recovery, which may bias the estimates of several key characteristics.

An improved system and method is needed to provide high quality and uninterrupted core samples.

SUMMARY

In certain aspects, the present inventive concept provides a system and method for obtaining a core sample using cryogenic cooling.

In one implementation, a system for collecting a core sample comprises an outer cylindrical tube having a first opening and a second opening, a drive head coupled to the first opening of the outer cylindrical tube, and a drive shoe coupled to the second opening of the outer cylindrical tube. The system also includes a cooling chamber housed at least partially within the outer cylindrical tube, the cooling chamber having an enclosed upper portion, an enclosed bottom portion, and an annulus between a first cylinder and a second cylinder, wherein the first cylinder and the second cylinder are concentric and the first cylinder is within the second cylinder. The system further includes insulation housed at least partially within the outer cylindrical tube, a core sample liner, an inlet tube, and an outlet tube. The drive shoe of the system comprises a first, second, and third step, the first step configured to receive the insulation, the second step configured to receive the cooling chamber, the third step configured to receive the core sample liner, wherein the first step has a diameter larger than the second step and the second step has a diameter larger than the third step. The annulus of the cooling chamber is configured to receive a cooling liquid near the bottom portion from the inlet tube and to discharge the cooling liquid near the upper portion to the outlet tube. The inlet tube and outlet tube each pass through a first opening and a second opening of the drive head and a first opening and a second opening of the cooling chamber and are configured to circulate the cooling liquid to thereby freeze and collect a core sample in the core sample liner.

In another implementation, a method for collecting a core sample is provided, wherein the method comprises drilling a hole in the ground with a drilling tool, the drilling tool housing an outer cylindrical tube, a drive head, and a drive shoe. The drive head is coupled to a first opening and the drive shoe is coupled to a second opening of the outer cylindrical tube. The method also comprises enclosing a core sample by a core sample liner of the drive shoe and freezing the core sample via a cooling liquid delivered and received by an inlet tube and an outlet tube, respectively, to a cooling chamber. The cooling chamber of the method has an enclosed bottom and top portion and an annulus between a first cylinder and second cylinder and is enclosed by insulation, the outer cylindrical tube, and the drive head. The first cylinder and the second cylinder are concentric and the first cylinder is within the second cylinder. The cooling liquid is delivered into the annulus of the cooling chamber from the inlet tube near the bottom portion of the cooling chamber and exits the annulus at the top portion of the cooling chamber into the exhaust tube. The drive shoe comprises a first, second, and third step, the first step configured to receive the insulation, the second step configured to receive the cooling chamber, the third step configured to receive the core sample liner, wherein the first step has a diameter larger than the second step and the second step has a diameter larger than the third step. The method also includes the steps of retrieving the drilling tool at a surface of the ground and removing the core sample encased in the core sample liner from the cooling chamber.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTION OF THE DRAWINGS

FIGS. 12A-H show visual logs of sediments collected from four locations at the former refinery including fluid saturation, fluid content, and porosity of frozen cores.

DETAILED DESCRIPTION

Figure 1:
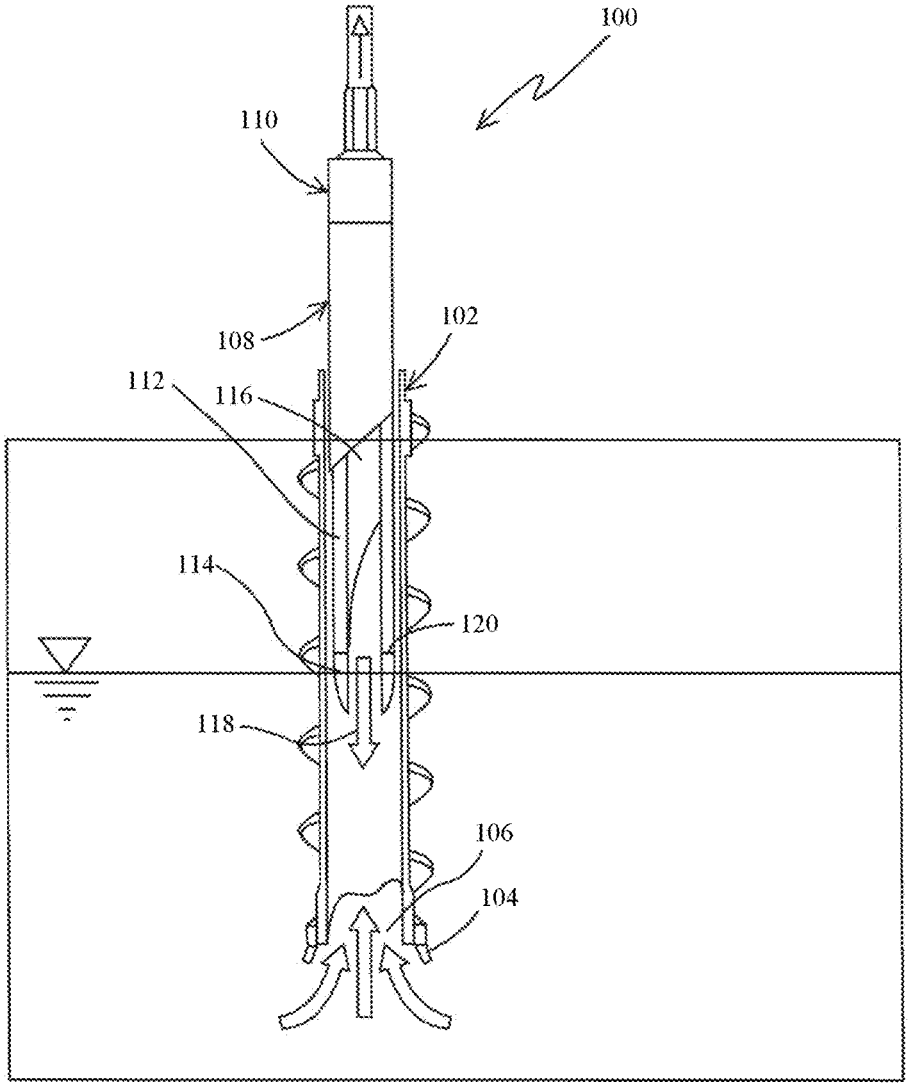
FIG. 1 is a cross-sectional side view of a conventional hollow stem auger with a continuous sampling system (prior art).

Aspects of the present disclosure involve a system and method for obtaining a core sample from ground surface and subsurface media using a system for collecting a core sample in conjunction with a drilling tool. Certain embodiments provide a system and method for obtaining a core sample using cryogenic cooling. The system and method for collecting a core sample can be used with a variety of drilling tools and methods, including auger drilling, direct push, and rotosonic drilling.

In certain embodiments, the present disclosure provides systems and methods for the in situ collection of cryogenic cores from surface and subsurface media. As used herein, the term "ground surface and subsurface media" includes consolidated and unconsolidated ground surface and subsurface media, such as rock, soils, sands, sediments, gravels, clays, etc. In accordance with the disclosure, the collected cryogenic cores will preserve critical core attributes, including contaminant concentrations, fluid saturations, hydraulic conductivity, and biogeochemical conditions. By way of non-limiting example, the systems and methods of the disclosure enable efficient collection of core samples that preserve core attributes including volatile gases (e.g., chlorinated solvents and hydrocarbons) and microbes that may be present in the sampled ground surface and subsurface media.

As will be explained in further detail herein, the systems and methods of the disclosure incorporate and utilize insulation in a manner so as to focus cooling into the core sample in a controlled manner to efficiently freeze the sample while minimizing heavy of the sample. Controlled cooling of the core sample allows for efficient recovery of core samples. In certain embodiments, the systems and methods are provided such that media, e.g., sediments and sands, below the drive shoe (as explained in further detail herein) are controllably frozen, thereby reducing the likelihood of flowing sands.

In one implementation, the system for collecting a core sample comprises an outer cylindrical tube having a first opening and a second opening, a drive head coupled to the first opening of the outer cylindrical tube, and a drive shoe coupled to the second opening of the outer cylindrical tube. The system also includes a cooling chamber housed at least partially within the outer cylindrical tube, the cooling chamber having an enclosed upper portion, an enclosed bottom portion, and an annulus between a first cylinder and a second cylinder. The system further includes insulation housed at least partially within the outer cylindrical tube, a core sample liner, an inlet tube, and an outlet tube. In certain embodiments, the insulation is positioned outside at least a portion of the cooling chamber. In other words, the insulation is positioned between the inner wall of the outer cylindrical tube and at least a portion of the cooling chamber. The drive shoe of the system comprises a first, second, and third step, the first step configured to receive the insulation, the second step configured to receive the cooling chamber, the third step configured to receive the core sample liner, wherein the first step has a diameter larger than the second step and the second step has a diameter larger than the third step. The annulus of the cooling chamber is configured to receive a cooling liquid near the bottom portion from the inlet tube and to discharge the cooling liquid near the upper portion to the outlet tube. The inlet tube and outlet tube each pass through a first opening and a second opening of the drive head and a first opening and a second opening of the cooling chamber and are configured to circulate the cooling liquid to thereby freeze and collect a core sample in the core sample liner.

In certain embodiments, a hole is created in the ground using a drilling tool, and after a sufficient hole is drilled by the drilling tool, the system for collecting a core sample is pushed into the hole. A cooling liquid is circulated through the cooling chamber of the core sample collecting system to effectively surround and freeze the core sample. The drive head of the system is configured to allow the cooling liquid to reach a bottom portion of the core sample. In certain embodiments, the drive head may freeze sample material that extends beyond the system to thereby create a "frozen plug". The frozen plug prevents flowing sands from entering the system and ensures that the entire core sample is intact during recovery. After the core sample is frozen, the system for collecting a core sample is brought to the surface of the drilled hole, the core sample is retrieved from the system and collected, where it may be sent to a lab for processing and study. As discussed above, the insulation of the system provides for controlled cooling of the core sample to efficiently freeze the sample.

In another implementation, a method for collecting a core sample is provided, wherein the method comprises drilling a hole in the ground with a drilling tool, the drilling tool housing an outer cylindrical tube, a drive head, and a drive shoe. The drive head is coupled to a first opening and the drive shoe is coupled to a second opening of the outer cylindrical tube. The method also comprises enclosing a core sample by a core sample liner of the drive shoe and freezing the core sample via a cooling liquid delivered and received by an inlet tube and an outlet tube, respectively, to a cooling chamber. The cooling chamber of the method has an enclosed bottom and top portion and an annulus between a first and second cylinder, wherein the first cylinder and the second cylinder are concentric and the first cylinder is inside the second cylinder. The cooling chamber is enclosed by insulation, the outer cylindrical tube, and the drive head, wherein the insulation is positioned outside of the second cylinder. The cooling liquid is delivered into the annulus of the cooling chamber from the inlet tube near the bottom portion of the cooling chamber and exits the annulus at the top portion of the cooling chamber into the exhaust tube. The drive shoe comprises a first, second, and third step, the first step configured to receive the insulation, the second step configured to receive the cooling chamber, the third step configured to receive the core sample liner, wherein the first step has a diameter larger than the second step and the second step has a diameter larger than the third step. The method also includes retrieving the drilling tool at a surface of the geological formation and removing the core sample encased in the core sample liner from the cooling chamber.

By way of background, FIG. 1 shows a cross-sectional side view of a prior art continuous sampling system 100. The continuous sampling system 100 includes a hollow stem auger 102 and an auger bit 104 near an open bottom 106 of the auger 102. The continuous sampling system 100 further includes a sample tube system 108 having a conventional drive head 110 and a sample tube 112 terminating in a conventional drive shoe 114. The sample tube 112 is shown with a core sample 116. The sample tube system 108 remains fixed as the auger 102 rotates. Non-cohesive material 118, such as sand, is shown flowing out of a bottom 120 of the sample tube 112 during the return of the continuous sampling system 100 to the ground surface, which may compromise the quality of the core sample 116.

Although an auger drill is used as an example drilling tool and method throughout the specification, the disclosure is not so limited and other forms of drilling tolls may be used such as direct push, sonic drilling, or the like. Furthermore, the systems and methods disclosed may be used to collect core samples overlain by water, such as a water table or sediments in a surface water body or core samples above a water or liquid portion. By way of non-limiting example, direct push drilling uses the static weight of a carrier to push rods into the ground to advance drilling tool devices. If needed, percussion energy can be used to aid drilling. Sonic drilling operates by bringing the drill string to a prescribed vibration frequency, which causes a thin layer of the soil particles to lose their structure. The vibration causes the soil to change to a higher density with a lower porosity, enabling the collection of long and continuous core samples.

Figure 2A:
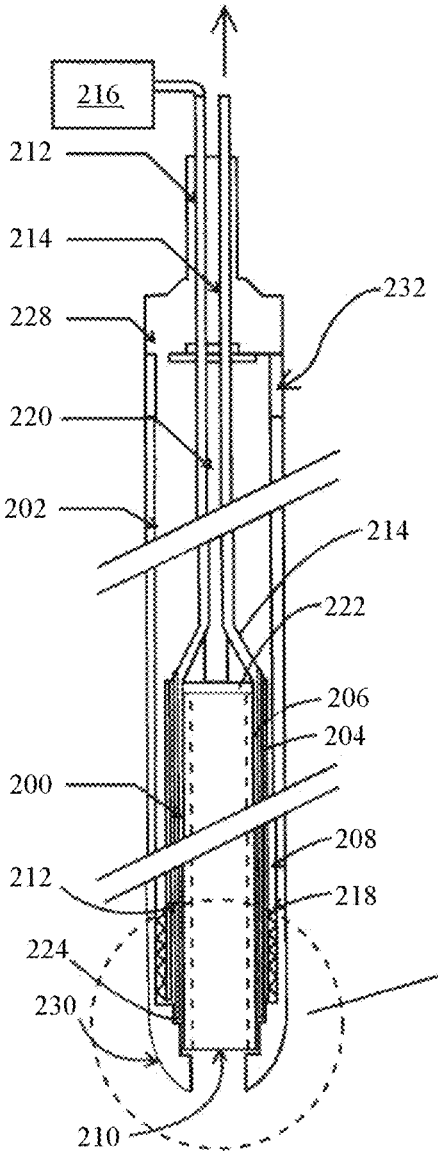
FIGS. 2A-B are a cross-sectional side view of a system for collecting a core sample having a drive shoe and cooling chamber and a close-up view of the drive head and cooling chamber, respectively.
Figure 2B:
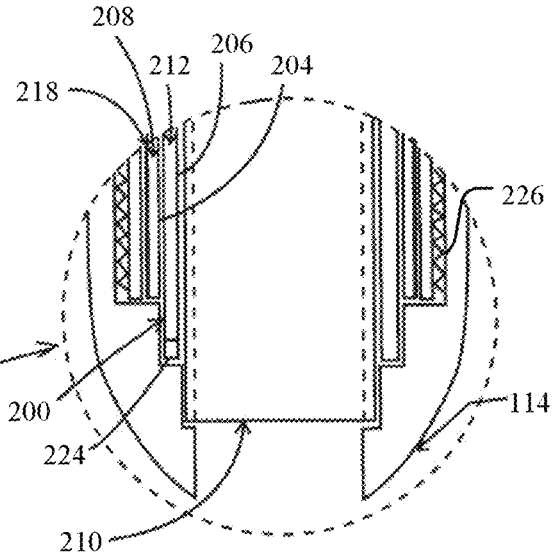

Referring to the drawings, FIGS. 2A-B show an exemplary system for collecting core sample in accordance with an embodiment of the disclosure. More specifically, FIG. 2A illustrates a cross-sectional side view of a system for collecting a core sample 232 having a drive shoe 230 and a cooling chamber 200 and FIG. 2B illustrates a close-up view of the drive shoe 230 and cooling chamber 200. The system for collecting a core sample 232 includes an outer cylindrical tube 202 having a first opening and a second opening. The drive head 228 is coupled to the first opening of the outer cylindrical tube 202 and the drive shoe 230 is coupled to the second opening of the outer cylindrical tube 202. The drive head 228 and drive shoe 230 may be coupled to the outer cylindrical tube 202 via a screw fit 226, press fit, or the like.

The cooling chamber 200 is housed at least partially within the outer cylindrical tube 202 and has an enclosed upper portion 222 and an enclosed bottom portion 224. The cooling chamber 200, may be, for example, partially or entirely within the outer cylindrical tube 202. The cooling chamber 200 also includes an annulus between a first cylinder 204 and a second cylinder 206, creating, for example, a dual-wall cooling chamber. The first cylinder and the second cylinder are concentric and the first cylinder is within the second cylinder. Insulation 208 is wrapped around at least a portion of the cooling chamber 200, which concentrates freezing to the core sample 116 inside the cooling chamber 200. In certain embodiments, the insulation 208 may be positioned at least partially around the outside the cooling chamber 200 and more specifically, around the second cylinder. Any suitable insulation material known in the art may be used, e.g., ¼ inch thick closed-cell foam and may be further wrapped in a tape 218. The tape may be polyvinyl chloride (PVC) tape, electrical tape, shrink wrap, or the like. The insulation 208 may wrap entirely or partially around an outer surface of the cooling chamber 200. In an example implementation, the insulation 208 may wrap around the outer surface of the cooling chamber 200 except for the portion of the cooling chamber 200 in the drive shoe 230. In certain embodiments, such a configuration may facilitate freezing of soil and sample material below the drive shoe 230 and correspondingly, controls flowing sands. The core sample 116 is encased by a core sample liner 210, which allows the core sample 116 to be easily removed from the cooling chamber 200. The core sample liner 210 may be made of PVC, acetate, aluminum, or the like.

Figure 3:
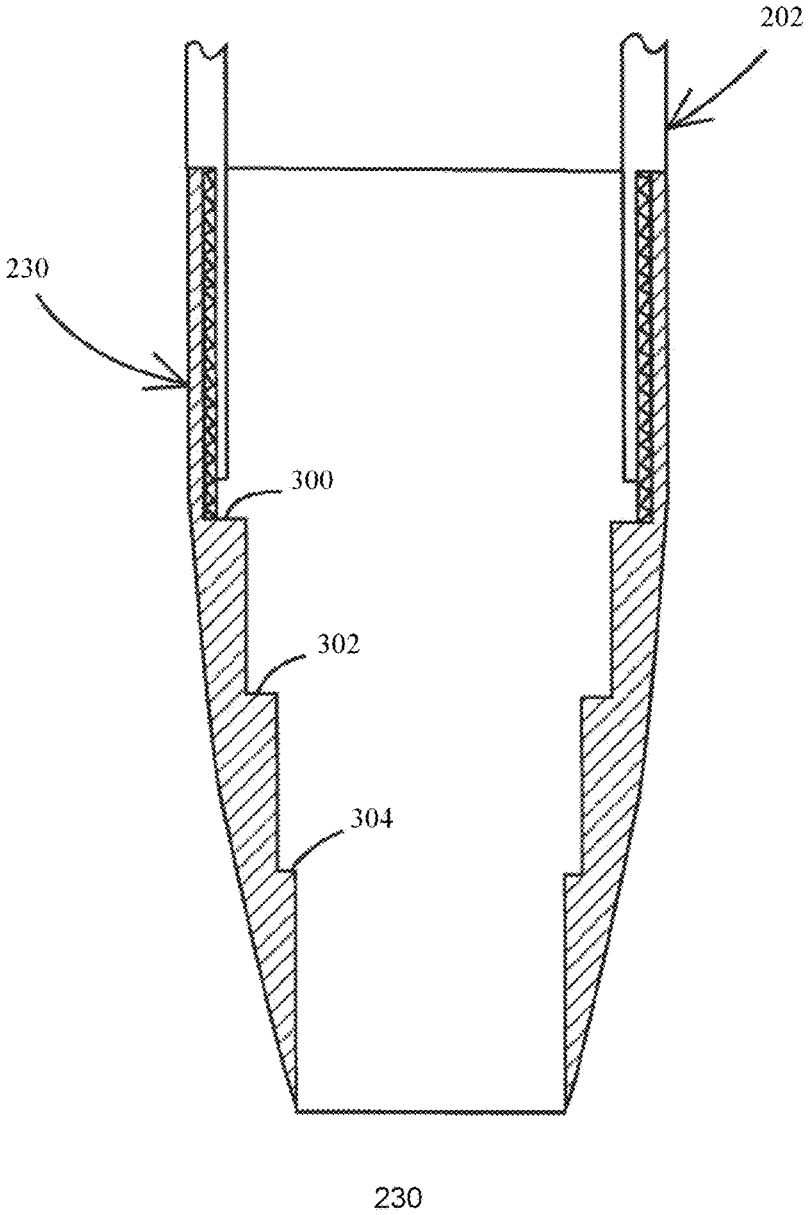
FIG. 3 is a cross-sectional close-up view of the drive head.

The drive shoe 230, shown in detail in FIG. 2B and FIG. 3, includes a first 300, second 302, and third step 304 to receive the insulation 208, the cooling chamber 200, and the core sample liner 210, respectively. The first step 300 has a diameter larger than the second step 302 and the second step 302 has a diameter larger than the third step 304. The drive shoe 230 allows the cooling chamber 200 to reach past the outer cylindrical tube 202 and into the drive shoe 230, thus allowing freezing to occur closer to the bottom of the core sample 116. The freezing may extend past the drive shoe 230 to create a "frozen plug", which can prevent flowing sands from entering the system for collecting a core sample 232.

Figure 4:
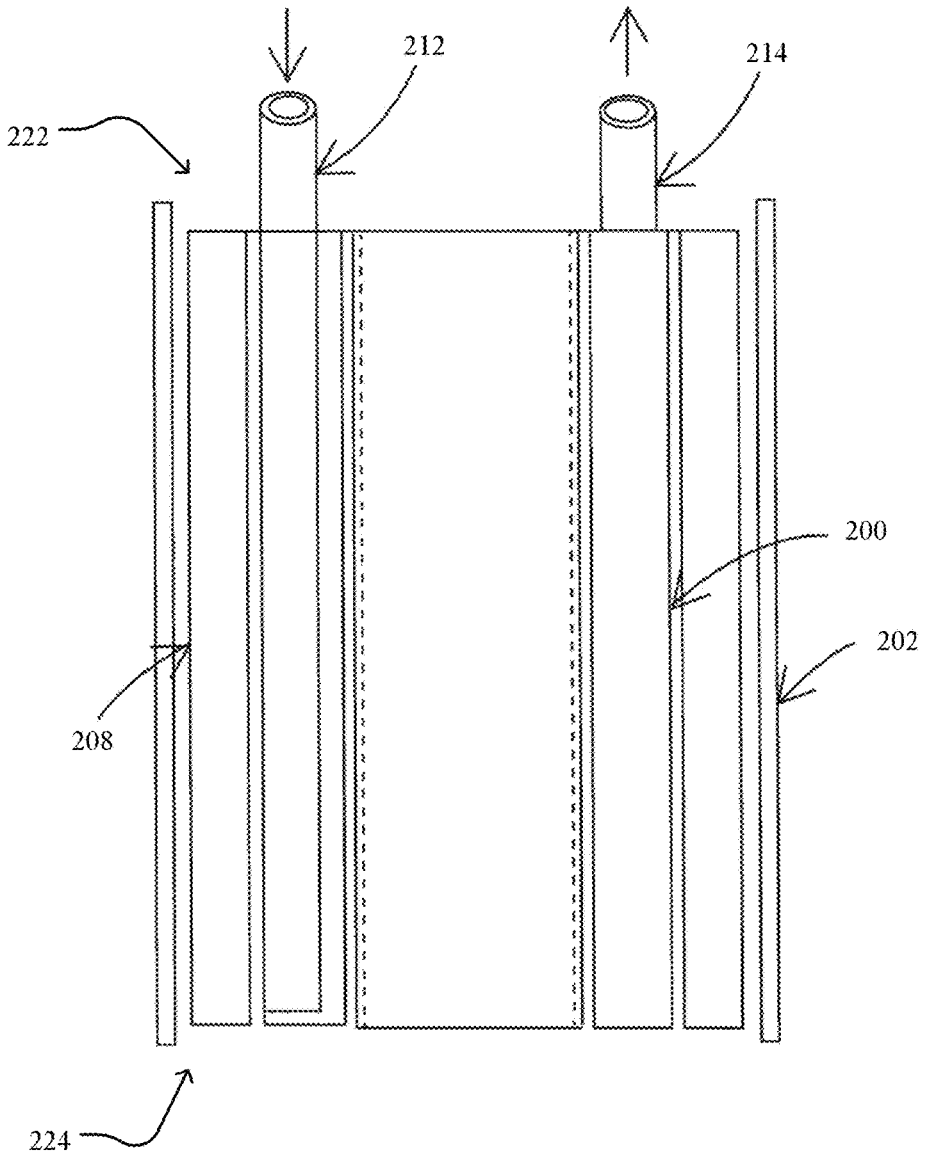
FIG. 4 is a cross-sectional side view of an example implementation for delivering a cooling liquid to a bottom portion of the cooling chamber.

An inlet tube 212 and an outlet tube 214 circulate a cooling liquid through the annulus of the cooling chamber 200, as shown in FIG. 2A and FIG. 4. The inlet tube 212 and the outlet tube 214 each pass through a first opening and a second opening of the drive head 228 and a first opening and a second opening of the cooling chamber 200. The inlet tube 212 delivers the cooling liquid from a cooling liquid source 216 into the annulus of the cooling chamber 200 near the bottom portion 224 and the outlet tube 214 receives the cooling liquid, thus circulating the cooling liquid in the annulus. The cooling liquid removes heat from the core sample 116 and continuous circulation of the cooling liquid freezes the core sample 116. The cooling liquid may be, for example, liquid nitrogen.

In an example implementation, shown in FIGS. 2A-B and 4, the inlet tube 212 enters the cooling chamber 200 at the upper portion 222 and travels down the cooling chamber inside the annulus to the bottom portion 224 and delivers the cooling liquid at the bottom portion 224. In other words, the second opening of the cooling chamber 200 is positioned at the upper portion 222 of the cooling chamber 200 where the inlet tube 212 enters the cooling chamber 200 and travels down inside the cooling chamber 200. In an alternative example, shown in FIG. 5, the inlet tube 212 travels down the outer wall 500 and in a depression 502 of the cooling chamber 200. The inlet tube 212 then connects to the second opening 504 positioned near the bottom portion 224 of the cooling chamber 200. The inlet tube 212 and outlet tube 216 may also be flattened to accommodate a larger inner diameter of the cooling chamber 200 without changing the overall dimensions of the cooling chamber 200. In another implementation, not shown, two cooling chambers are used concurrently wherein a second cooling chamber is placed in the drilling system immediately after withdrawal of the first cooling chamber. The second cooling chamber will limit movement of sand into the drilling system. In the intervening time in which the frozen core sample is removed from the first cooling chamber, the frozen sediment below the core sampled interval will have time to thaw, preventing the concern that frozen soils below the drive shoe could limit recovery.

By delivering the cooling liquid directly to the bottom portion 224 of the cooling chamber 200 and near the drive shoe 114, the core sample 116 may initially begin freezing near the drive shoe 230, which helps prevent flowing sands or other sediments from entering the system for collecting a core sample 232. A portion or the entirety of the inlet tube 212 and outlet tube 214 may be covered in insulation to further concentrate the freezing near the bottom of the cooling chamber 200.

Figure 5:
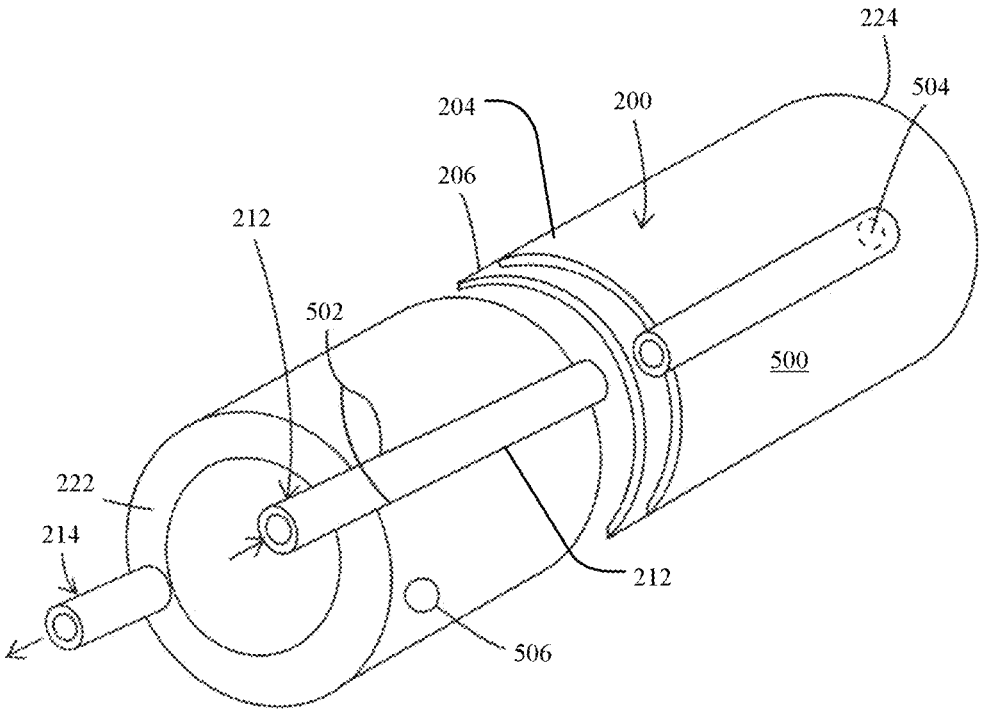
FIG. 5 is an isometric view of another example implementation for delivering the cooling liquid to the bottom portion of the cooling chamber.

The system for collecting a core sample 232 may also include a core sample liner adjustment rod 220, shown in FIG. 2A and at least one set screw 406, shown in FIG. 4. The adjustment rod 220 is configured to maintain a distance between the drive head 110 and the core sample liner 210. The at least one set screw 406, shown in FIG. 5, are configured to secure the position of the cooling barrel 200 in the outer cylindrical tube 202 and are positioned near a center of the cooling barrel 200. The at least one set screw 406 passes through the wall of the outer cylindrical tube 202 and the insulation 208 and stop in drilled holes at the top portion of the cooling chamber 200. In an example implementation, the at least one set screw 406 are a first set screw and a second set screw, wherein the first set screw is positioned near the middle portion of the outer cylindrical tube and the second set screw is positioned near the middle portion of the outer cylindrical tube opposite the first set screw.

Figure 6A:
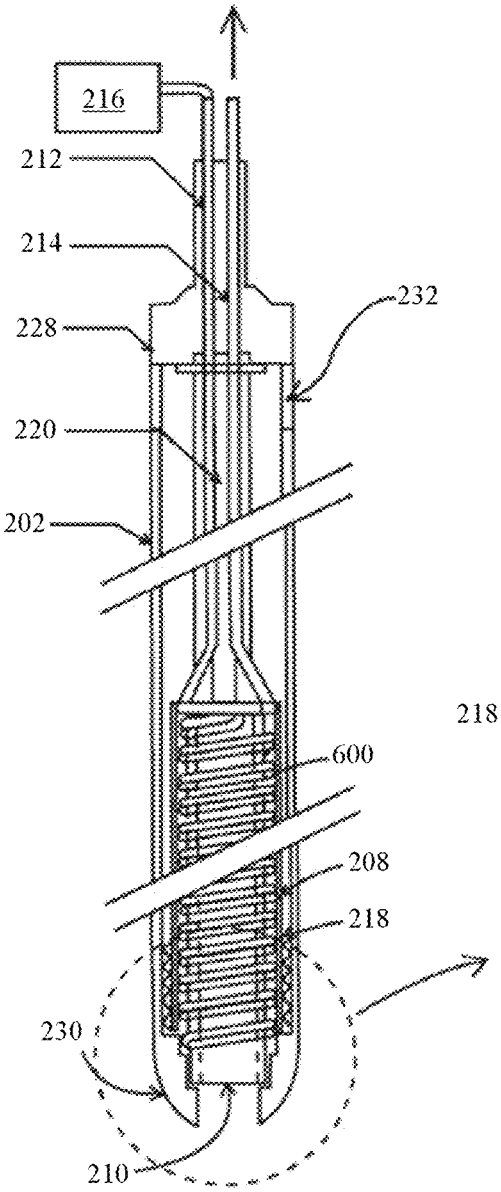
FIGS. 6A-B are a cross-sectional side view of an alternative implementation of the system for collecting a core sample having the drive shoe and a cooling coil and a close-up view of the drive head and cooling coil, respectively.
Figure 6B:
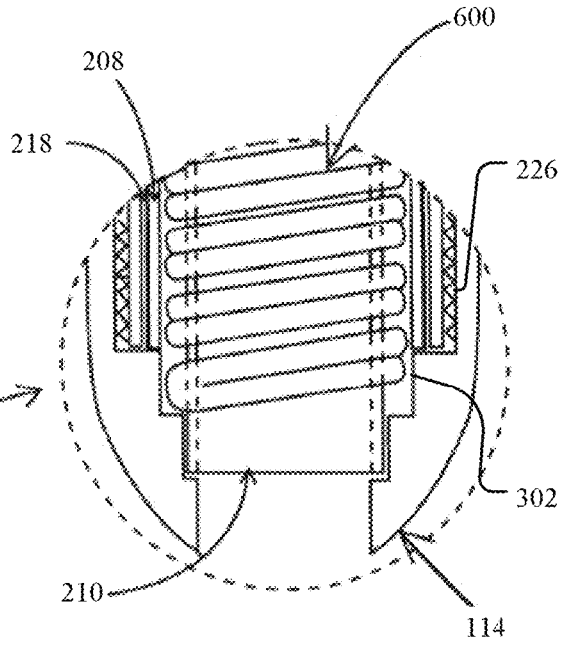

FIGS. 6A-B illustrate a cross-sectional side view of an alternative implementation of the system for collecting a core sample 232 having the drive shoe 230 and a cooling coil 600 and a close-up view of the drive shoe 230 and cooling coil 600, respectively. Similar to the first implementation having a cooling chamber 200, shown in FIGS. 2A-B, the alternative implementation includes a drive head 228 and a drive shoe 230 coupled to opposite ends of an outer cylindrical tube 202. An inlet tube 212 and outlet tube 214 circulate a cooling liquid from a cooling liquid source 216 throughout a cooling coil 600. The cooling coil 600 is wrapped around a core sample liner 210. The cooling coil 600 is wrapped by insulation 208 and covered with a tape 218. The tape may be PVC tape, electrical tape, shrink wrap, or the like.

The cooling coil 600 may be made from copper tubing and any diameter or length of copper tubing may be used. In one example, 50 feet of ⅜ inch copper tubing may be wrapped over 2.5 feet core sample liner 210 intervals. The inlet tube 212 and outlet tube 214 pass through the drive head 228 through a first opening and a second opening in the drive head 228 and connect to the cooling coil 600. The cooling coil 600 sits in the drive shoe 230, also shown in FIG. 3, having a first step 300, a second step 302, and a third step 304. As can be seen in FIG. 6B, the cooling coil 600 is positioned in the second step 302, providing for cooling as close to the bottom of the core sample 116 as possible.

In another implementation, not shown, the cooling coil 600 may have a 1 inch tall dual wall cooling chamber section at the top end portion of the cooling coil 600. The inlet tube 212 and the outlet tube 214 connect to the top of the short dual wall cooling chamber. The cooling liquid enters the short dual wall cooling chamber, passes through the cooling coil 600, reenters the cooling chamber, and exits through the outlet tube 214, effectively circulating the cooling liquid through the cooling coil 600.

Figures 7A, 7B, 7C, 7D:
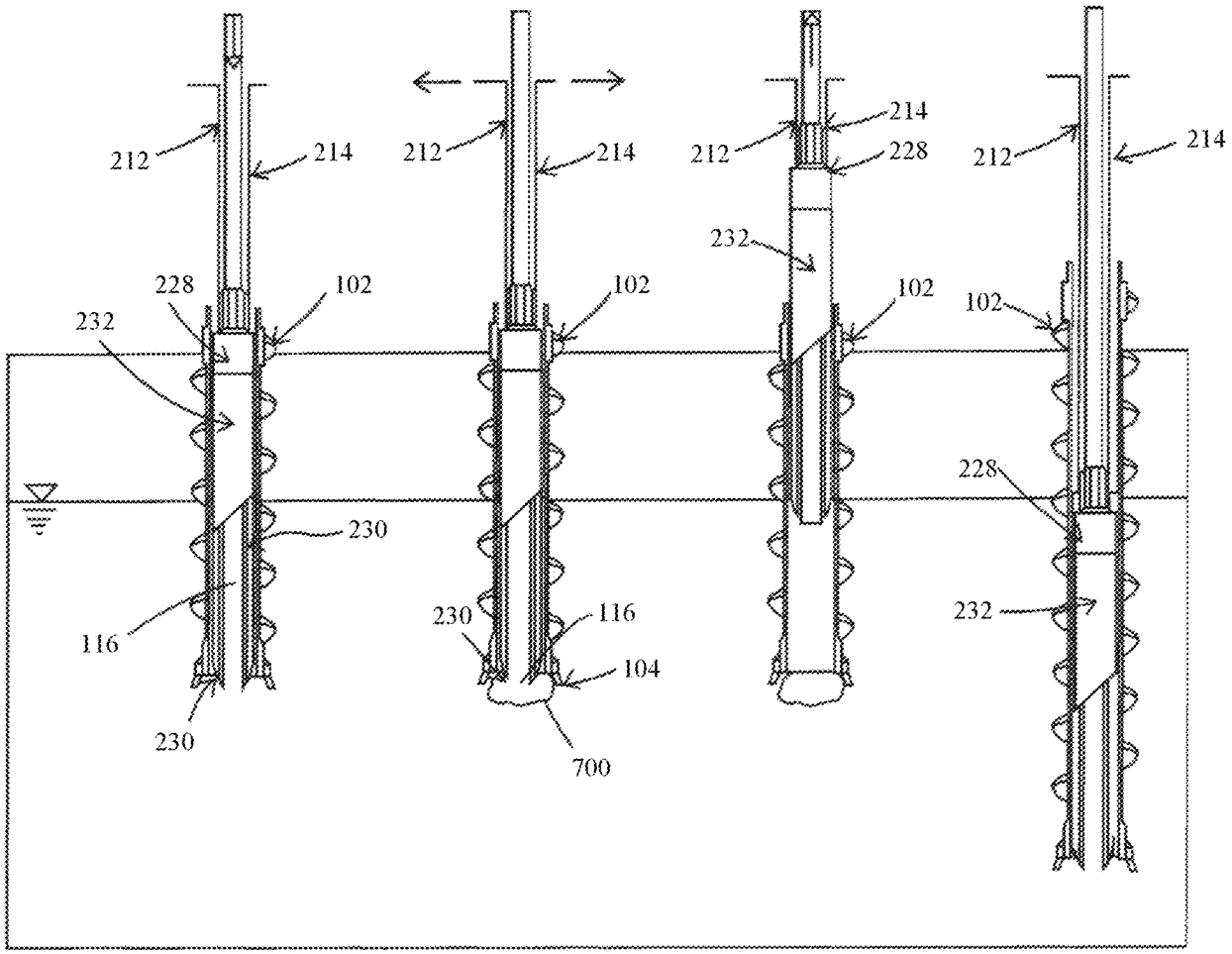
FIGS. 7A-D are a side cross-sectional view of advancing the system for collecting a core sample, freezing a core sample, recovering the core sample, and advancing the system for collecting a core sample for repeat sampling, respectively.

FIGS. 7A-D illustrate a side cross-sectional view of advancing a system for collecting a core sample 232, freezing a core sample 116, recovering the core sample 116, and advancing a system for collecting a core sample 232 for repeat sampling, respectively. FIG. 7A shows the concurrent advancement of the auger 102 and drive head 228, which forces the core sample 116 past the drive shoe 230 and into the core sample liner 210. FIG. 7B shows the cooling liquid being used to freeze the core sample 116, forming a frozen plug 700 below the drive shoe 230 and auger bit 104. FIG. 7C illustrates the frozen core sample 116 being brought to the surface for recovery with the frozen plug 700 remaining in place to control flowing sands, which may enter the bottom of the auger 102 due to unbalanced stresses at the drilling front. Not shown is the frozen core sample 116 being removed from the system for collecting a core sample 232 so that another core sample 116 may be obtained. FIG. 7D shows the auger 102 and drive head 228 being advanced another 2.5 feet where the steps in FIGS. 7A-C are repeated at this new location.

Extending the cooling system into the drive shoe without insulation improves freezing at the front of the core and reduces the effects of heaving sands by freezing the formation ahead of the drive shoe. Insulation around the reaming sections of the cooling coils/cylinder directs the cooling into the core samples and prevents the loss of cooling to the steel wall of the continuous sampling system and adjacent hollow stem auger. Insulation between the cooling coils or cooling chamber and the inner wall of the outer cylindrical tube facilitates rapid freezing and limits the effects of down hole ice locking (the inability to pull either the cryogenic sampling tool out of the hollow stem augers or ice forming on the outside of the sampling systems) of tools.

As a result of the buildup of ice and/or sediments between the liner and the cooling system, extraction of the core sample liners from the cooling coils/dual-wall cylinder may present a problem. Three solutions may be effectively employed: first, a hot-water power sprayer may be used to clean sediments in the system between uses. Second, when necessary, hot water may be used to thaw frozen contact points between the core sample liner and the cooling system. Third, food-grade oil may be applied to the outside of the core sample liner to limit direct contact of water with the core sample liner.

EXAMPLES

Several example experiments were conducted utilizing the basic steps of FIGS. 7A-D and an example system for collecting a core sample 232. The following parameters were used for the example system for collecting a core sample 233, which produced results which will be discussed subsequently. Three types of 2.5-inch OD core sample liners were used: acetate, PVC, and aluminum. Of the three, PVC provided the best combination of heat conduction, ease of use, and transparency, which facilitated visual inspection of the core samples in the field. Aluminum was not used due to the inability to view the core samples in the field and conduction of heat along the aluminum when cutting the core into subsections. Acetate tended to fail under extremely low temperatures. The core sample liners were cut to 5 or 2.5 feet in length to fit securely into the cooling coil or dual-wall cooling chamber, respectively. Using both the cooling coil and dual-wall cooling chamber, core samples were collected with cores having 2.5-ft. lengths. Cores with a 2.5-ft. length were found to yield better core recovery than 5-ft. long cores.

Example 1

Figure 8:
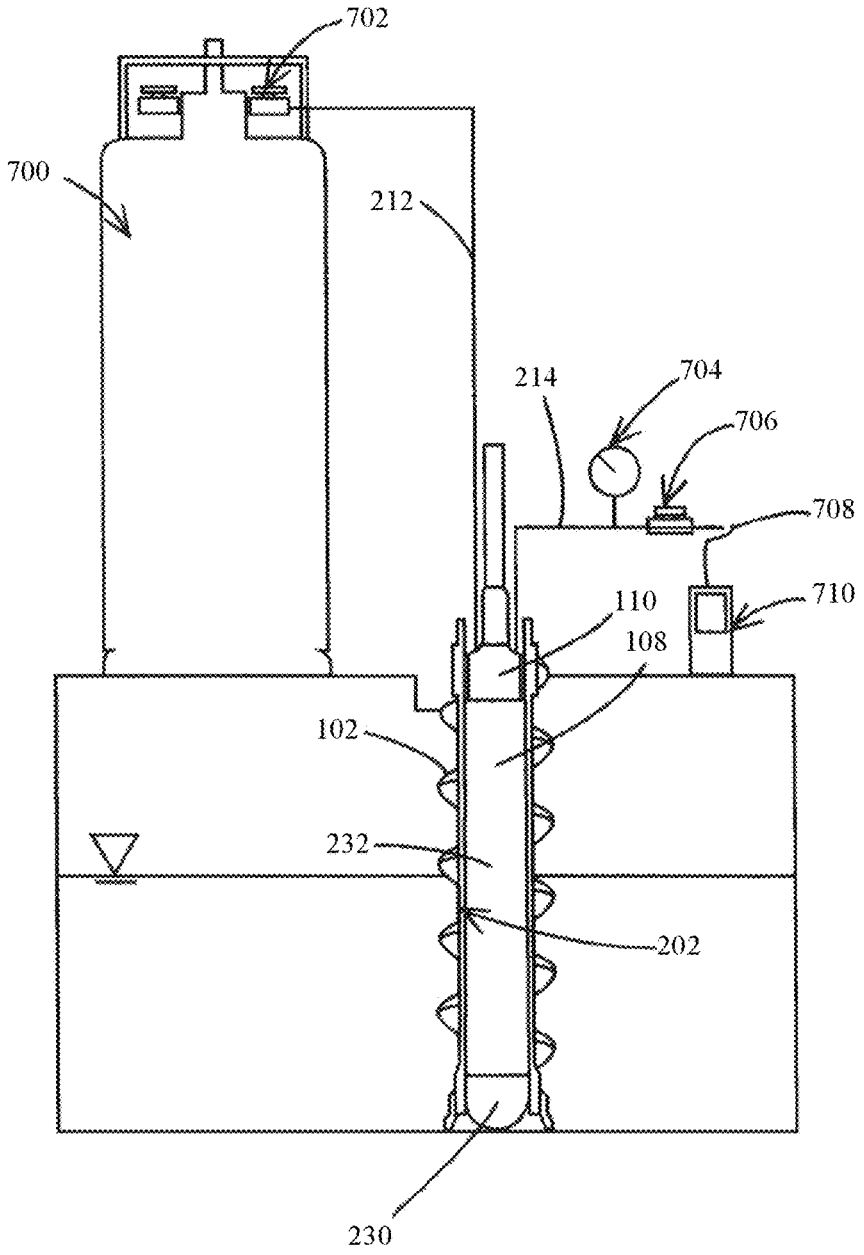
FIG. 8 is a side cross-sectional view of a liquid nitrogen cooling and backpressure control system connected to an outlet tube.

FIG. 8 is a side cross-sectional view of a cooling liquid and backpressure control system connected to the exhaust line 214. In an example implementation of the backpressure control system, the cooling liquid is liquid nitrogen. The liquid nitrogen was maintained at approximately 200 psi from a cooling liquid container 800, in this example, a 230 psi/160 L Dewar. A discharge valve 802 was left open until freezing temperature at 0 C.° was achieved in the exhaust line 214, as measured by a thermocouple 808 and a digital temperature meter 810. A manual discharge throttle valve 806 was used to create 100 psi back pressure measured on a pressure gage 804, once the freezing temperature was achieved.

Cooling was typically achieved in 5-10 minutes using a system for collecting a core sample using a cooling coil, in this example, the cooling coil is a copper coil. Approximately 9 lbs. of liquid nitrogen were required per foot of the frozen core. To minimize cooling losses, the inlet tube and outlet tube were 5-foot long stainless-steel tubes with a ⅜-inch outer diameter, wrapped with approximately ¼" closed-cell foam insulation and covered with heat-shrink tubing. Considering a saturated core with a porosity of 27.5%, the theoretical amount of liquid nitrogen needed to reduce the solid/water system to 0 C and freeze the water is 7.5 lbs of liquid nitrogen per foot of frozen core. Therefore, the present cryogenic coring systems are estimated to be 83% efficient.

Example 2

Figure 9:
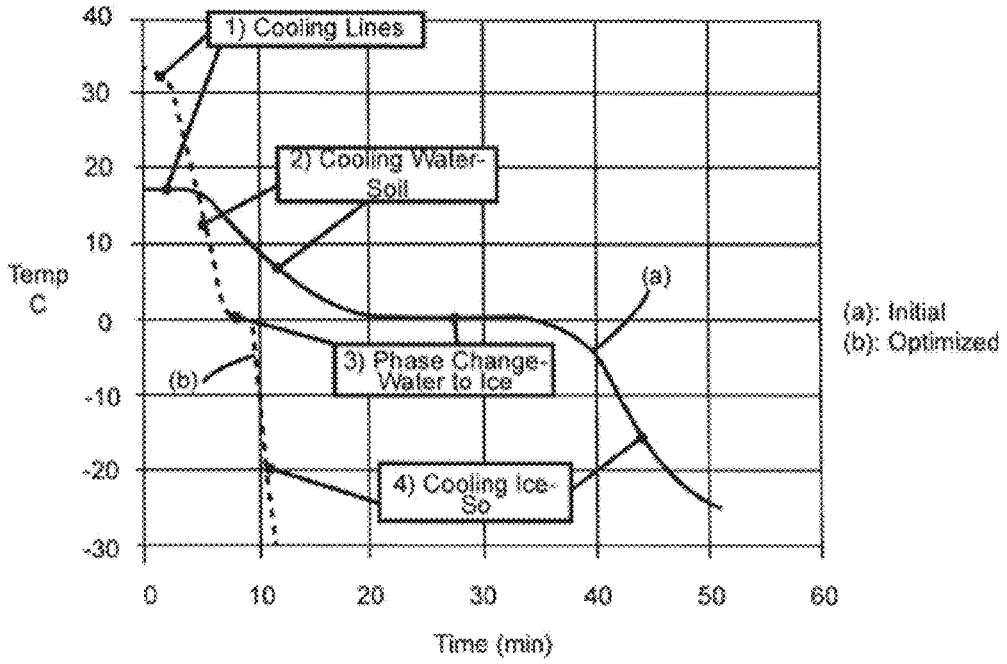
FIG. 9 is a graph of a temperature as a function of time for freezing core samples.

FIG. 9 is a graph of temperature versus time acquired using fabricated cores (cores filled with water-saturated medium sand, placed inside the system for collecting a core sample 232, and placed inside hollow-stem auger flights located both above and below the water table) equipped with thermocouples in the center of the cores with an example cooling coil. This example illustrated the advantage of using insulation versus no insulation. The initial cooling coil system employed 200 feet of ¼-inch copper tubing and no insulation. The final cooling coil system employed 50 feet of ⅜-inch copper tubing with insulation. The data show four phases of cooling: 1) cooling the lines leading to the core sample, 2) cooling the core, 3) a temperature plateau associated with the heat of freezing water (heat of fusion), and 4) cooling the fully-frozen core. Based on the data, the time to reach full freeze of the core samples (temperature below 0 C.°) was reduced by 74.3%, from 35 minutes to 9 minutes.

Figure 10:
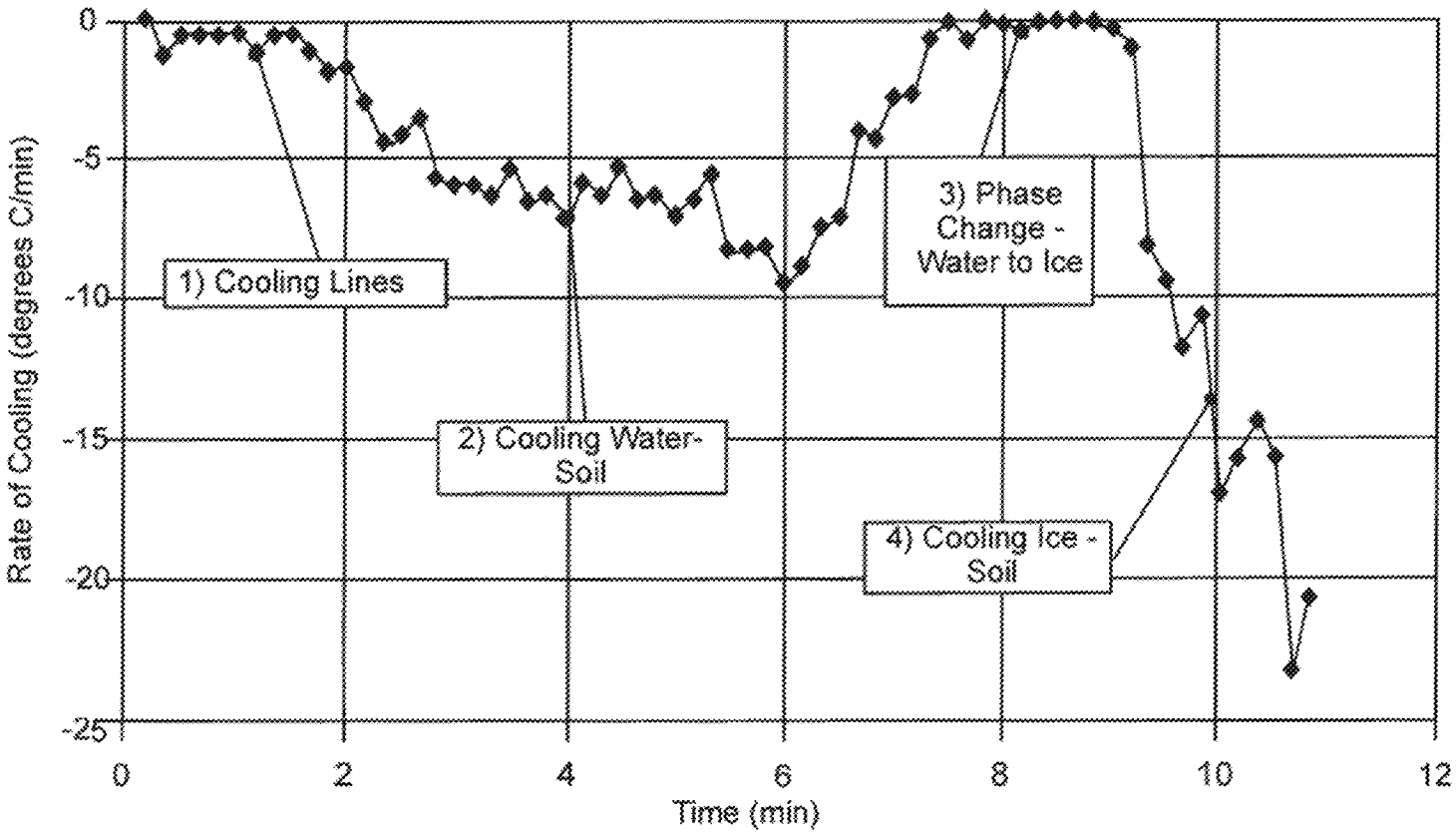
FIG. 10 is a graph of the observed rates of temperature change as a function of time within the core liner.
Figure 11A:
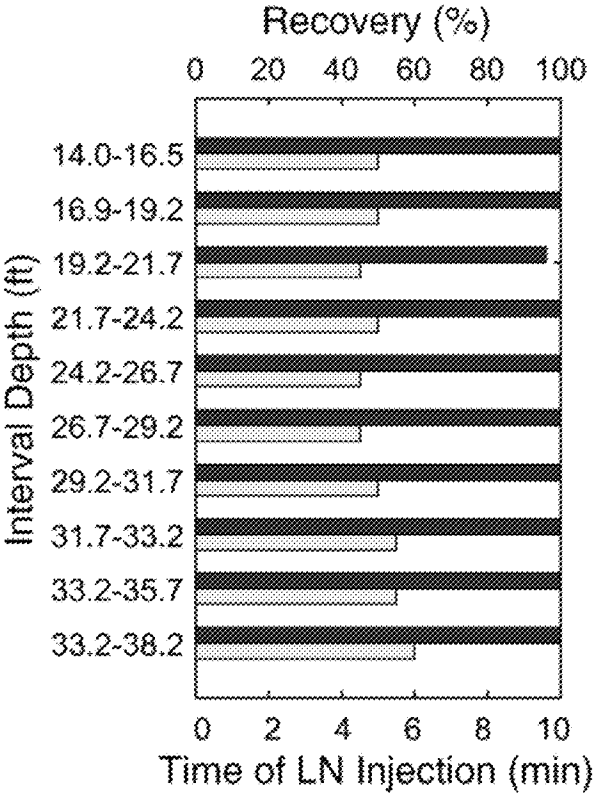
FIGS. 11A-G illustrate graphs of the core sample core recovery and time of cooling liquid injection system at Francis E. Warren AFB and a former refinery site in the Western U.S.
Figure 11B:
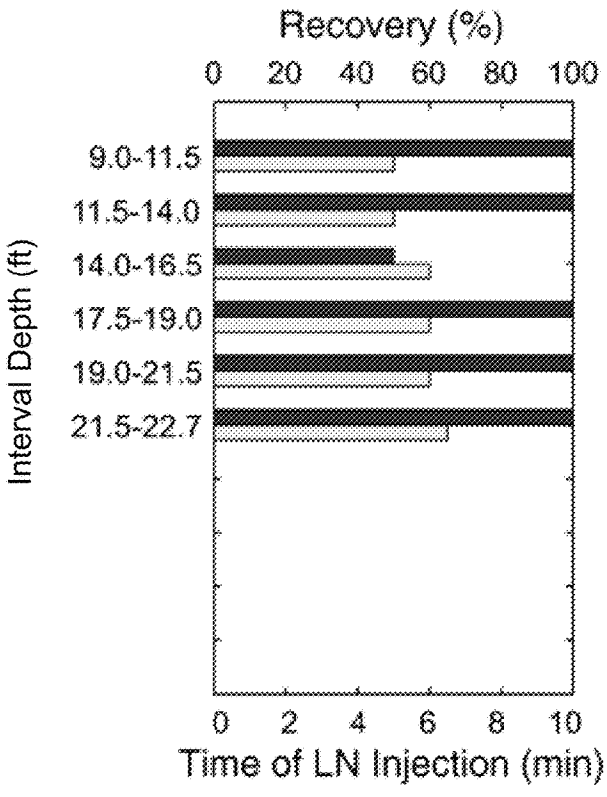
Figure 11B:
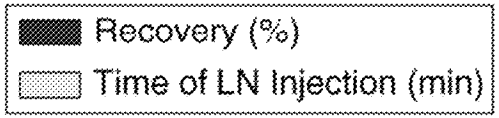
Figures 11C, 11D:
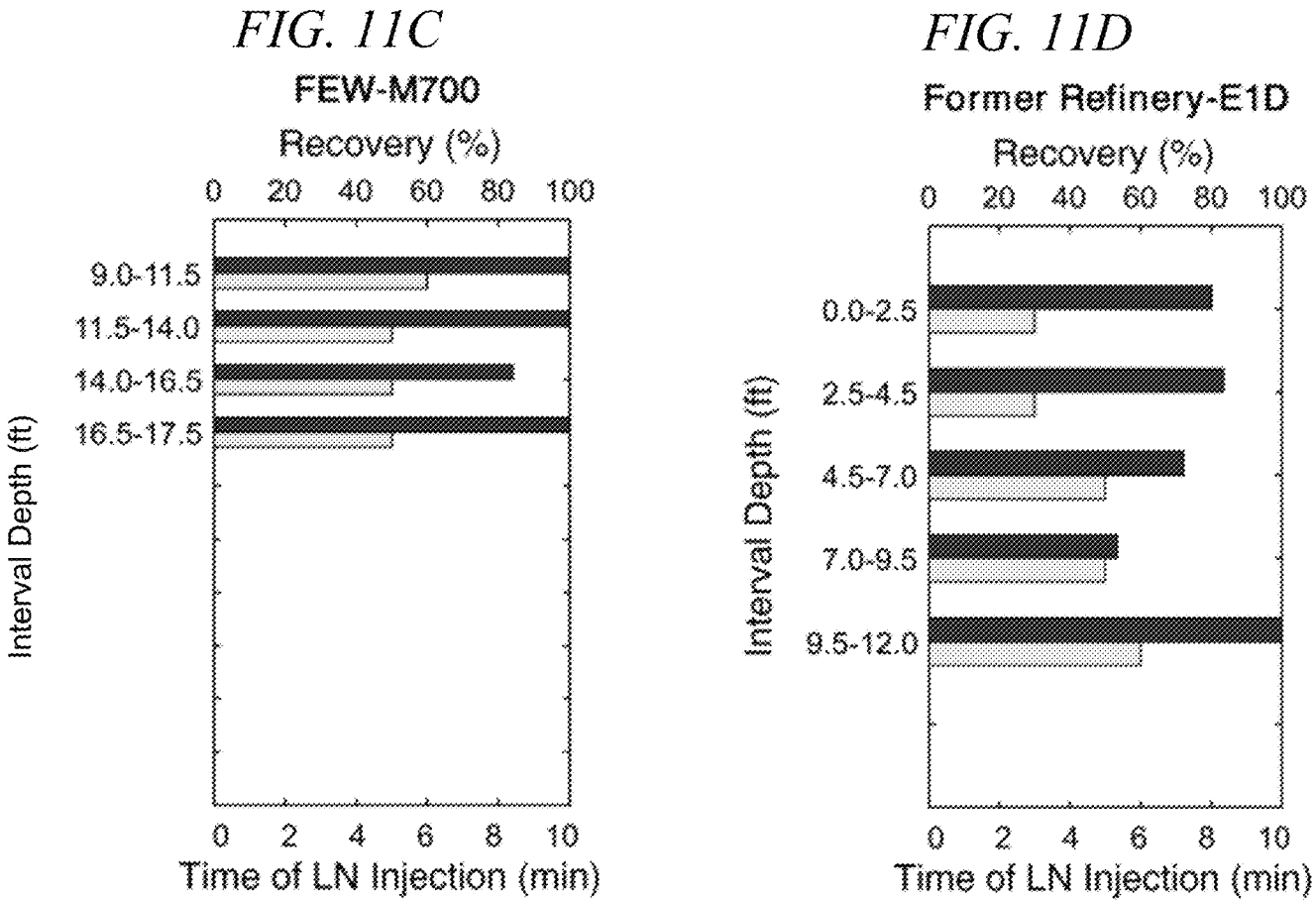
Figure 11E:
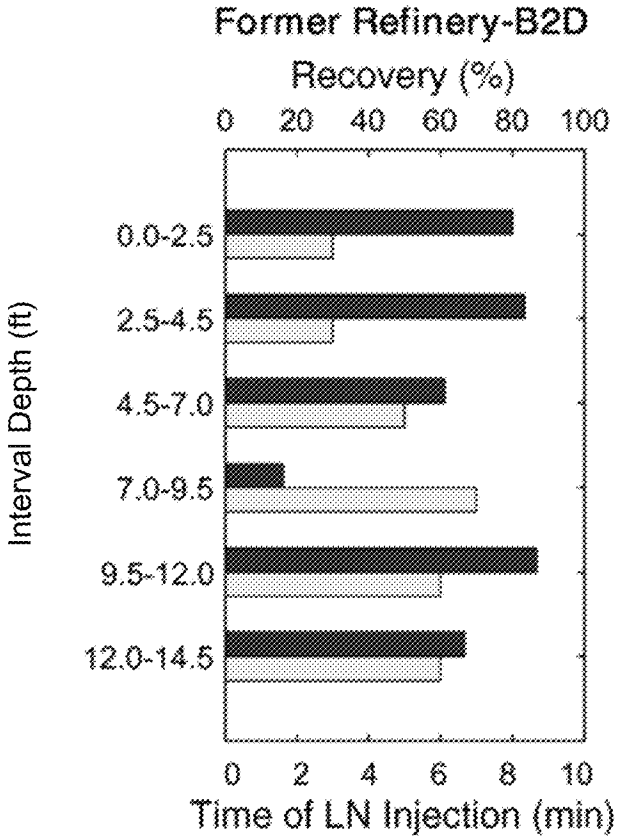
Figure 11F:
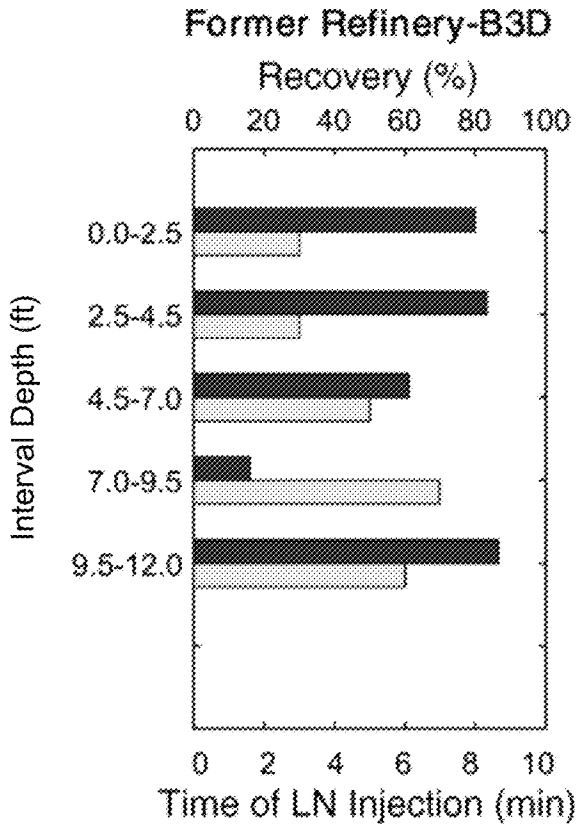
Figure 11F:
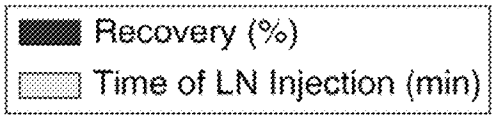
Figure 11G:
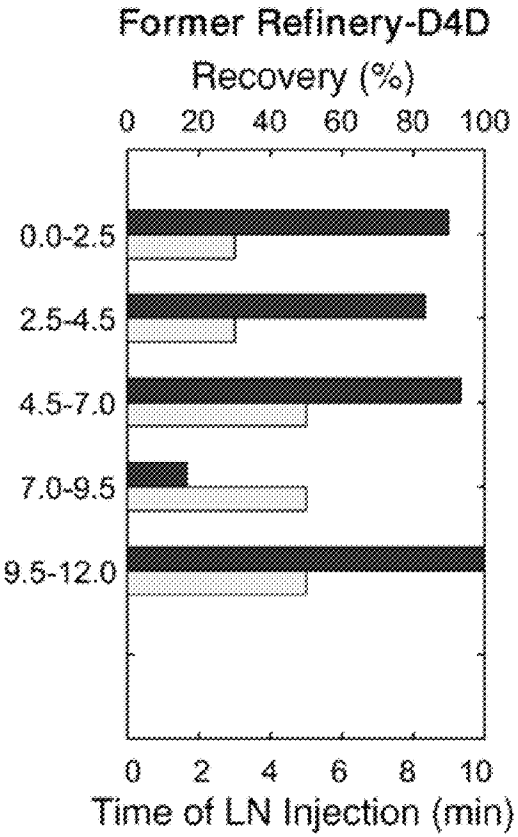

An alternative way to consider the data is observed rates of change of core temperatures as a function of time, shown in FIG. 10, which shows the four phases of freezing the pre-packed soil cores. First, the thermal diffusion front reaches the thermocouple at the center of the core. Second, the cooling rate is controlled by water's heat of fusion. Third, the cooling rate slightly decreases as the freezing front approaches the thermocouple. Last, the cooling rate increases rapidly after the core is completely frozen.

Example 3

The effectiveness of the disclosed systems and methods were further tested and evaluated above and below the water table at two contaminated field sites: (1) the Francis E. Warren (FEW) AFB in Cheyenne, Wyo. and (2) a former refinery in the western U.S. (dual-wall and coil core sample collection systems). A Central Mining Equipment (CME) 75 HSA drilling system was employed.

Liquid Nitrogen (LN), which provides temperatures as low as −196° C. at atmospheric pressure, was used as the coolant. 160-L LN Dewars with 230-psi (15.8-bar) internal pressure were employed. A 0.75-inch (19-mm) vacuum jacket tube was used to connect the LN Dewar to the downhole delivery line. The delivery and exhaust lines consisted of 5-foot (152-cm) long, 0.375-inch (10-mm) OD sections of stainless-steel tubes, insulated with 0.25-inch (6.4-mm) closed-cell neoprene insulation and covered with heat-shrink PVC tubing. The 5-foot (152-cm) sections were connected with stainless-steel Swagelok™ (Solon, Ohio) unions.

A cryogenic throttle valve and pressure gage were placed on the exhaust line above ground surface to control back pressure in the cooling systems. Optimal cooling was achieved by (1) maintaining about 200 psi (13.8 bar) at the Dewar, (2) initially imposing zero back pressure at the exhaust in order to maximize flow, and (3) after 0° C. was observed at the exhaust, closing the throttle valve to achieve a back pressure of approximately 100 psi (6.9 bar) in the exhaust line to maintain the nitrogen in a liquid state adjacent to the core.

Operationally, the following steps are generally followed in collection of a frozen core sample. First, the drilling tool (e.g., hollow stem auger) and core sample collection system are advanced a selected distance, e.g., 2.5 feet (76 cm) into the ground. Second, LN is delivered into the system to freeze the core sample. In certain embodiments, a frozen zone of sediment is also formed around the exterior of the drive shoe. Third, the core sample collection system is withdrawn from the drilling tool, and the frozen sample is retrieved to the ground surface. The frozen core sample is removed from the core sample liner, and a new core sample liner is installed in preparation for subsequent sampling. The collected core sample is inspected to verify freezing, measured to determine the percent of recovery, capped on the ends, labeled, and immediately placed horizontally on dry ice in a cooler for preservation purposes.

In conducting the example, it was observed that, for some cores, the core liners froze to the cylinder. This was addressed by briefly (less than 20 seconds) running hot water from a pressure washer through the cooling system to thaw the film of ice holding the core in the system.

An objective of the systems and methods described herein is to improve the preservation and analysis of core sample attributes. A three-step process of sub-dividing a sample (i.e., subsampling), preserving the "sub-samples," and subsequent sample analyses is referred to here as "high-throughput analysis" (HTA). The combined processes of systems and methods of the disclosure, and HTA allow all core processing to be conducted in the laboratory, versus in the field, and on a timeframe that is flexible (because the cores are kept frozen).

Other advantages of laboratory processing include (1) elimination of weather-related sample biases, (2) access to better environmental control devices (e.g., hoods, gloves, etc.), (3) improved accuracy of measurements (e.g., weights and volumes), and (4) enhanced safety because staff are not deployed to field sites.

As discussed herein, frozen core samples can be used to examine a broad set of physical, chemical, and biological characteristics of media. As an example, the distribution of fluid saturations (i.e., water, NAPL, and gases) in frozen cores collected from test sites are reported in the present example. Other parameters for which preservation analysis can be improved by in situ freezing of core samples in accordance with the present disclosure include: (1) volatile organic compounds, (2) redox-sensitive inorganic water quality indicators (e.g., Fe(II), $H_2$, $H_2S$, $O_2$) and minerals (e.g., FeS), and (3) microbial ecology and activity.

Through three field efforts and 5 days of drilling, 146 feet of frozen core were collected. Of the 146 feet of core, all but 10 feet were collected using a system for collecting a core sample with a cooling coil, wherein the cooling coil was a copper coil. The average core sample core rate was about 30 feet/day. Through subsequent cryogenic coring at four additional sites, an excess of 240 feet of frozen core was collected solely using a system for collecting a core sample with a cooling chamber of the disclosure. Based on prior coring at all sites, cryogenic cooling required approximately 50% more time than conventional sampling systems, however, recovery from targeted intervals was improved and key attributes were preserved.

Frozen cores were collected from various locations at the test sites. By way of example, frozen cores were cut into 1-inch (25.4-mm) sub-sections, referred to as "hockey pucks," at 4-inch (101-mm) intervals using a circular chop saw. Cuts were completed in 5 to 10 s, and the hockey pucks remained frozen at the surface of the cut and through the body of the sample. Subsequently, hockey pucks were quartered into "subsamples" and preserved. One of the sub-samples was placed in high purity (ACS/HPLC certified) methanol (Honeywell Burdick & Jackson, Muskegon, Mich.). The concentration of total petroleum hydrocarbons ($C_{TPH*}$) in the methanol extract were resolved by gas chromatography.

The minimum concentration of total petroleum hydrocarbons in which LNAPL is observed in subsamples under UV light is referred to as the "cut-off concentration" ($C_{cut\text{-}off}$). Consequently, concentrations of LNAPL ($C_{LNAPL}$) in subsamples were determined by subtracting $C_{cut\text{-}off}$ from $C_{TPH*}$.

A second subsample was weighed, placed in deionized (DI) water, and the volume of displaced water was weighted. The displaced water mass was used to estimate the total volume of the sample, $V_t$ $$V_t = M_w/\rho_w \tag{1}$$

where $M_w$ is the mass of water instantaneously displaced by the sample and $\rho_w$ is the density of water (assumed to be 1 gm/cm$^3$). Subsequently, the second sample was dried and reweighed. Collectively, the initial sample weight, displaced water volume, TPH concentration, and final sample weight were used to resolve physical parameters, including porosity, fluids saturation, and fluids content using Equations 2 through 6:

$$\phi = 1 = (M_d/V_t \cdot \rho_p) \tag{2}$$

$$C_{LNAPL} = C_{TPH} - C_{Cut\text{-}Off} \tag{3}$$

$$S_{LNAPL} = (C_{LNAPL} \cdot M_d/\rho_{LNAPL})/(V_t - (M_d/\rho_p)) \tag{4}$$

$$S_w = (V_l - (C_{LNAPL} \cdot M_d/\rho_{LNAPL}))/(V_t - (M_d/\rho_p)) \tag{5}$$

$$S_g = 1 - (S_{LNAPL} + S_w) \tag{6}$$

$$\theta = S\phi \tag{7}$$

where ø is porosity, $M_d$ is the mass of dry soil, $S_{LNAPL}$, $S_W$, and $S_G$ are the LNAPL, water and gas saturations, respectively. θ is the volumetric fluid content, calculated for each fluid phase. $V_l$ is the liquid (water+LNAPL) volume in the sample. In this example the particle density, $\rho_p$, was assumed to be 2.65 g/cm$^3$, and $\rho_{LNAPL}$ was assumed to be 0.8 g/cm$^3$.

Sediment subsamples in methanol and DI water were visually logged under visible and ultra-violet (UV) light by a professional geologist. Descriptions of the sediments follow the guidelines for hydrogeological logging of samples presented in Sterrett, R. J. 2007. *Groundwater and Wells,* 3rd ed. New Brighton, Minn.: Johnson Screens. Recorded attributes include sediment type, sorting, grain-size distribution, color, and presence of NAPL. Florescence induced by UV light was used to identify the presence of LNAPL (Cohen, R. M., A. P. Bryda, S. T. Shaw, and C. P. Spalding. 1992. Evaluation of visual methods to detect NAPL in soil and water. *Groundwater Monitoring & Remediation*, Vol. 12, No. 4: 132-141).

FIGS. 11A-G show core sample recoveries and time required to inject the cooling liquid to freeze the cores from field work at FEW AFB and the former refinery site. At FEW the recovery rate was close to 100% whereas at the refinery site recovery varied between 16 and 100%, with a median of 80%. Without the cooling chamber, recovery was extremely poor at less than 15%. Furthermore, 5 to 7 minutes of cooling liquid delivery was enough to freeze a 2.5 foot core above and below the water table.

Figures 12G, 12H:
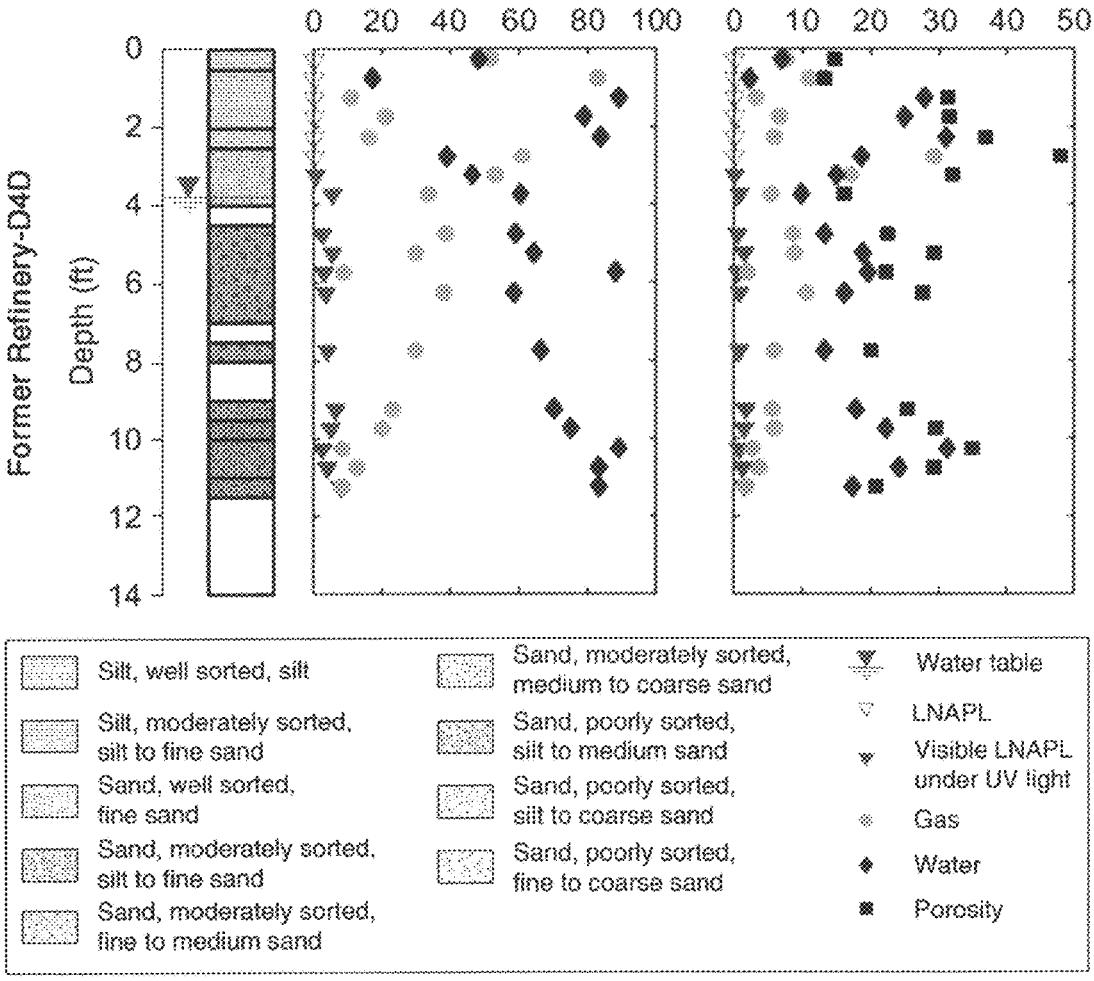

FIGS. 12A-H shows visual logs of sediments collected from four locations at the former refinery including fluid saturation in FIGS. 12A, C, E, and G and fluid content and porosity of frozen cores in FIGS. 12B, D, F, and H. The sediments generally graded from fine to coarse with depth, as is typically seen in stream deposits. Sediment colors graded from reds and browns above 4 feet (1.22 m) bgs to gray and black below 4 feet (1.22 m) bgs (colors not illustrated in figure, but depths are indicated). Reds and browns are attributed to oxidized iron minerals. Grays and blacks are attributed to reduced metal sulfides associated with anaerobic degradation of petroleum hydrocarbons.

In summary, in situ freezing of the core in accordance with embodiments of the present invention can improve the recovery of the core by limiting losses of core from system for collecting a core sample during core sample recovery and control flowing sands. Pore fluids, including water, non-aqueous phase liquids (NAPLs), and gases, may be maintained at original levels since such cores can be stored at low temperatures, which will preserve key parameters during transport to a laboratory and storage before analysis. Losses of volatile compounds can be limited in water and NAPL, and sorbed phases, particularly for compounds with large Henry's coefficient (i.e., chlorinated solvents), where losses through volatilization can be large. Additionally, common aqueous phase chemical reactions can be prevented, since primary chemical reactions of concern require free liquid water molecules for a reaction to proceed, as opposed to immobile water molecules in frozen water.

A laboratory-base will allow for high-throughput analysis of frozen cores, providing a larger amount of data that more accurately represents in situ conditions than data generated from field-processing of unfrozen cores. Additionally, medical scanning methods such as MRI can be used to provide continuous data from frozen cores.

The description above includes example systems, methods, techniques, and/or instruction sequences that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A system for collecting a core sample comprising:

an outer cylindrical tube having a first opening and a second opening; a drive head coupled to the first opening of the outer cylindrical tube; a drive shoe coupled to the second opening of the outer cylindrical tube; a cooling chamber housed at least partially within the outer cylindrical tube, the cooling chamber having an enclosed upper portion, an enclosed bottom portion, and an annulus between a first cylinder and a second cylinder; insulation housed at least partially within the outer cylindrical tube; a core sample liner; an inlet tube; and outlet tube;

wherein the first cylinder and the second cylinder are concentric and the first cylinder is within the second cylinder;

wherein the drive shoe comprises a first, second, and third step, the first step configured to receive the insulation, the second step configured to receive the cooling chamber, the third step configured to receive the core sample liner, wherein the first step has a diameter larger than the second step and the second step has a diameter larger than the third step;

wherein the annulus of the cooling chamber is configured to receive a cooling liquid near the bottom portion from the inlet tube and to discharge the cooling liquid near the upper portion to the outlet tube; and wherein the inlet tube and outlet tube each pass through a first opening and a second opening of the drive head and a first opening and a second opening of the cooling chamber, and are configured to circulate the cooling liquid to thereby freeze and collect a core sample in the core sample liner.

2. The system of claim 1, wherein the inlet tube enters the annulus of the cooling chamber at the upper portion and extends through the annulus to the bottom portion.

3. The system of claim 1, wherein the inlet tube extends down a depression on an outer surface of the cooling chamber to the bottom portion and delivers the cooling liquid via a hole positioned near the bottom portion.

4. The system of claim 1, wherein the insulation at least partially wraps around the cooling chamber and is configured to direct cooling to the core sample.

5. The system of claim 4, wherein the insulation does not wrap around the portion of the cooling chamber within the drive shoe.

6. The system of claim 5, further comprising a first tube insulation and a second tube insulation wherein the first tube insulation is wrapped around the inlet tube and the second tube insulation is wrapped around the outlet tube.

7. The system of claim 5, further comprising a shrink wrap wrapped around the insulation.

8. The system of claim 5, further comprising electrical tape wrapped around the insulation.

9. The system of claim 1, further comprising an adjustable drive rod configured to maintain space between the drive head and the core sample liner.

10. The system of claim 1, wherein the core sample liner is positioned inside the cooling chamber.

11. The system of claim 1, further comprising the outer cylindrical tube.

12. The system of claim 11, further comprising at least one set screw positioned near a middle portion of the outer cylindrical tube, wherein the at least one set screw is configured to secure the position of the cooling chamber within the outer cylindrical tube.

13. The system of claim 12, wherein the at least one set screw are a first set screw and a second set screw, wherein the first set screw is positioned near the middle portion of the outer cylindrical tube and the second set screw is positioned near the middle portion of the outer cylindrical tube opposite the first set screw.

14. The system of claim 1, further comprising a drilling tool, wherein the drilling tool houses the outer cylinder, drive shoe, and drive head.

15. The system of claim 14, wherein the drilling tool is an auger tool, a push drilling tool, or a rotosonic tool.

16. A method for collecting a core sample, the method comprising: drilling a hole in the ground with a drilling tool, the drilling tool housing an outer cylindrical tube, a drive head, and a drive shoe; wherein the drive head is coupled to a first opening and the drive shoe is coupled to a second opening of the outer cylindrical tube; enclosing a core sample by a core sample liner of the drive shoe, freezing the core sample via a cooling liquid delivered and received by an inlet tube and an outlet tube, respectively, to a cooling chamber, the cooling chamber having an enclosed bottom and top portion and an annulus between a first and second cylinder; wherein the first cylinder and the second cylinder are concentric and the first cylinder is within the second cylinder; wherein the cooling chamber is enclosed by insulation, the outer cylindrical tube, and the drive head; wherein the insulation at least partially wraps around the cooling chamber; wherein the cooling liquid is delivered into the annulus of the cooling chamber from the inlet tube near the bottom portion of the cooling chamber and exits the annulus at the top portion of the cooling chamber into the outlet tube; wherein the drive shoe comprises a first, second, and third step, the first step configured to receive the insulation, the second step configured to receive the cooling chamber, the third step configured to receive the core sample liner, wherein the first step has a diameter larger than the second step and the second step has a diameter larger than the third step; retrieving the drilling tool at a surface of the ground; and removing the core sample encased in the core sample liner from the cooling chamber.

17. The method of claim 16, wherein the drilling tool is a auger tool, push drilling tool, or a rotosonic tool.

18. The method of claim 16, further comprising controlling the back pressure of the cooling liquid.

19. The method of claim 18, wherein the back pressure is held at 100 psi during delivery of the cooling liquid.

20. The method of claim 16, wherein the insulation does not wrap around the portion of the cooling chamber within the drive shoe.

* * * * *